US006098751A

United States Patent [19]

Eichenlaub et al.

[11] Patent Number: 6,098,751

[45] Date of Patent: Aug. 8, 2000

[54] STUDIO LAMP SCAFFOLD SYSTEM

[75] Inventors: R. Stephen Eichenlaub; George Natale, both of Chino, Calif.

[73] Assignee: Mountain Box Systems, Chino, Calif.

[21] Appl. No.: 09/151,033

[22] Filed: Sep. 10, 1998

[51] Int. Cl.[7] ..... E04G 3/10

[52] U.S. Cl. ..... 182/150; 182/130; 182/222

[58] Field of Search ..... 182/45, 87, 112, 182/113, 130, 142, 145, 146, 150, 222, 223

[56] References Cited

U.S. PATENT DOCUMENTS

| | | | |
|---|---|---|---|
| 2,057,092 | 10/1936 | Geib | 182/150 X |
| 2,070,334 | 2/1937 | Garber | 182/150 X |
| 2,485,165 | 10/1949 | Pollman | 182/223 |
| 3,250,345 | 5/1966 | Behr et al. | 182/223 X |
| 3,747,898 | 7/1973 | Warren | 182/113 X |
| 3,752,262 | 8/1973 | Heims | 182/113 |
| 3,756,568 | 9/1973 | Mocny et al. | 182/113 X |
| 3,825,098 | 7/1974 | Shingler | 182/113 X |
| 3,908,793 | 9/1975 | Vaughn et al. | 182/223 X |
| 4,352,597 | 10/1982 | Kay | 182/222 X |
| 4,413,707 | 11/1983 | Lienhard, Sr. | 182/150 |
| 4,496,029 | 1/1985 | Kuroda | 182/222 |
| 4,620,612 | 11/1986 | Enoki et al. | 182/113 |
| 4,782,914 | 11/1988 | Nail | 182/113 |
| 4,815,563 | 3/1989 | Puccinelli et al. | 182/150 |
| 4,919,230 | 4/1990 | Langer et al. | 182/223 X |
| 5,121,812 | 6/1992 | Ochiai et al. | 182/222 X |
| 5,141,078 | 8/1992 | Wood | 182/222 |
| 5,145,030 | 9/1992 | Pavlescak et al. | 182/113 |
| 5,145,032 | 9/1992 | Puccinelli et al. | 182/142 |
| 5,161,640 | 11/1992 | Holbrooks et al. | 182/222 X |
| 5,579,866 | 12/1996 | Rowell | 182/150 |
| 5,617,931 | 4/1997 | Zygmun et al. | 182/150 X |
| 5,678,654 | 10/1997 | Uzawa | 182/150 |
| 5,711,400 | 1/1998 | Tan | 182/222 X |

*Primary Examiner*—Daniel P. Stodola
*Assistant Examiner*—Richard M. Smith
*Attorney, Agent, or Firm*—Sheldon & Mak

[57] ABSTRACT

A scaffold system in which a scaffold bed is suspended between a pair of channel members. The channel members are horizontally disposed in respective frames that include a spaced pair of column members. The bed is modular and provides a deck surface that is formed by a plurality of panel members that are joined by a pair of beam members. The panel members have retainer flanges at opposite ends thereof, the end most retainer flanges of the bed engaging respective ones of the channel members. Each of the column members is provided with a retainer for holding the bed engaged with the channel members. Handrails are selectively connectable between the column members in elevated relation to the deck surface. The retainers are adopted for connecting wall braces for laterally stabilizing the system. The frames can rest on stationary supports, or they can be configured as hangers for suspension by tension members.

26 Claims, 5 Drawing Sheets

73
15
72
71
75
70
12
54
56
18
14
21

16
37
36
26
46
32
28
38
47
38
34
24
75
70
79
77
55
54
12
4
30
66
68
B
C
50
60
51
59
58
62
65
64
76
53
Ø
63
18
56

22
21
42
40
4

STUDIO LAMP SCAFFOLD SYSTEM

BACKGROUND

The present invention relates to scaffolding, and more particularly to scaffolding that is adapted for supporting studio lighting, grip and sound components.

Studio sound stages are typically equipped with heavy wooden scaffolding known as "greenbeds" that form hanging catwalks as aerial lamp platforms above studio sets. These typical scaffolds have a standard width of 42 inches and have a load rating of 19 lb/ft. In an exemplary form of such construction, decks are made using spaced 1×2" to 1×6" lattice boards that extend between parallel-spaced 2×4" or heavier beams, longitudinal stringers being fastened on the boards near the beams. A longitudinal spaced series of holes are drilled vertically through the stringers and some of the boards for receiving yoke stems of fixtures such as stage lamps. Reinforcing rings can be fastened to the stringers at some hole locations. Some decks have longitudinal planks on the boards and spaced between the stringers, and some decks have wire mesh nailed to the undersides of the boards for collecting fallen objects. The decks are supported between hanger frames that are suspended from chains, each frame including a pair of 2×4" wooden columns, a 2×4" top cross member and top corner braces, and a pair of bottom cross members fastened to opposite sides of the columns. Inside surfaces of the columns can have straps fastened thereto for receiving 2×4" handrails and the like, the straps having holes therein for nailing the handrails in place. The scaffolding is braced laterally by 2×4" lumber that is nailed between the columns and wall cleats.

There are significant shortcomings associated with the existing scaffolding of the prior art, for example:

1. Set-up and adjustment is difficult and labor-intensive in that the components are undesirably heavy, weighing typically 43 lb/ft to 51.3 lb/ft;

2. Maintenance is increasingly expensive, requiring repeated purchases of scarce clear lumber that is mandated for wooden greenbeds, and rebuilding of the greenbeds requires excessive time;

3. They are dangerous to use in that things can fall through or off of them, and they are subject to structural failure increasingly as the lumber material degrades; and 4. Utility is restricted by the presence of bulky handrails, so that an elaborate scaffold can support only few fixtures.

Thus there is a need for stage scaffolding that overcomes the disadvantages of the prior art.

SUMMARY

The present invention meets this need by providing a modular construction of lightweight, versatile and safe scaffolding in a number of configurations. In one aspect of the invention, a scaffold hanger includes a frame having a horizontally spaced pair of tubular column members, and an upwardly facing channel member rigidly connected horizontally between the column members proximate lower extremities thereof; means associated with each of the column members for connecting a support element for vertically transmitting load forces between the support element and the respective column member; a pair of retainer modules, each retainer module slidingly engaging a respective column member and having a collar portion for slidingly guiding and retaining the retainer module on the column member; a vertically oriented face portion; and a dog portion projecting horizontally outwardly relative to the column member, the face portion having a plurality of fastener openings formed therein for connecting a structural member; and means for holding each retainer module in a lowered position with the dog portion thereof fixedly spaced above the channel member.

The means for connecting can include a pair of support elements axially engaging respective ones of the column members, each of the support elements being secured by a respective support fastener, the support fastener transversely projecting through one of the column member and the support element and at least partly through the other of the column member and the support element. The column members can be tubular, opposite walls thereof having respective transversely oriented support fastener openings formed therein proximate upper and lower extremities of the column members for securing respective pairs of the support elements to the column members.

The frame can further include a top cross member rigidly connected between upper extremities of the column members. The means for holding can include each of the retainer modules having a set-screw threadingly engaging the collar element, or the collar element including a movable jaw member, for clamping the column member.

At least one of the retainer modules can include a gusset portion that is vertically oriented perpendicular to the face portion and having a further plurality of the fastener openings formed therein. The scaffold hanger can further include a shelf portion projecting horizontally perpendicular to a bottom extremity of the gusset portion for temporarily supporting a structural member to be fastened to the gusset portion. The gusset portion can be one of a horizontally spaced pair of gusset portions.

At least one of the dog portions can form a foot plate, opposite ends of the foot plate projecting horizontally beyond opposite sides of the column member, the foot plate having a further plurality of the fastener openings formed therein for fastening the dog portion to the bed. A side extremity of the foot plate can extend proximate a bottom extremity of the face portion and parallel thereto. The scaffold hanger can further include a horizontal boot bar rigidly extending between the column members and spaced below the channel member.

In another aspect of the invention, a scaffold assembly incorporates a spaced pair of the scaffold hangers, and further includes a scaffold bed having a deck surface, transversely oriented downwardly projecting retainer members proximate opposite ends of the bed for engaging respective ones of the channel members, and opposite longitudinal edge deck portions being spaced apart sufficiently for engagement by each of the dog portions of the scaffold hangers for holding the scaffold bed connected between the channel members. The scaffold bed can include a plurality of rigid rectangular panel members for forming the deck surface, each panel member having opposite end and side edges; a parallel-spaced pair of beam members, upper surfaces of the beam members forming the edge deck portions of the bed; and fastener means for rigidly connecting the panel members in adjacent coplanar relation between the beam members. The beam members can project above the deck surface, inside portions of the beam members forming respective edge barriers of the bed. Each panel member can include a shell member, a pair of rigidly downwardly projecting retainer flange portions extending along respective ones of the end edges, a pair of the retainer flange portions forming the retainer members, and the fastener means including a spaced plurality of beam fastener openings being formed in each of the side edges. The fastener means can include a pair of threaded deck fasteners connecting each beam member to respective side edges of each of the panel members, the beam members projecting above the panel members and spacing the edge deck portions above the deck surface for forming respective edge barriers.

Preferably the bed further includes a socket member having a cylindrical opening therethrough for receiving a fixture yoke shank on a socket axis, the socket member being located proximate an edge of the deck surface, the socket axis being inclined outwardly and upwardly relative to the deck surface. The socket axis can be inclined at an angle $\phi$ from being normal to the deck surface, the angle $\phi$ being between approximately 20 degrees and approximately 35 degrees. Preferably the angle $\phi$ is approximately 24 degrees.

The scaffold assembly can further include a deck extension cantilevered from one of the hangers and abutting the bed. The deck extension can be supported by the channel member of one of the hangers, being tied to the bed by the retainer modules thereof. The scaffold assembly can further include a handrail member connected between the hangers in spaced relation above the bed. Preferably a pair of the column members has respective projections formed thereon for supporting the handrail, the handrail having respective hook members rigidly formed on opposite ends thereof for partially enclosing the columns, a pair slidingly supported latch members for releasably securing the corresponding hook members on the respective column members, and closure members for releasably holding the latch members in closed positions thereof, nose portions of the latch members projecting into respective openings of the hook members in the closed positions for supporting the latch members on opposite sides of the column members, thereby strengthening the connection of the handrail to the column members.

The scaffold assembly can include an auxiliary scaffold hanger connected in depending relation to the bed by extension members that project into a pair of the tubular column members, the auxiliary hanger including an upwardly facing auxiliary channel member connecting a spaced pair of auxiliary column members, the extension members forming upper extremities of the auxiliary column members. The auxiliary hanger is used when vertical offset is desired between adjacent scaffold decks, the connection being effected by fasteners engaging auxiliary fastener openings of the extension members and transverse column fastener openings of the tubular column members. The extension members are preferably formed with vertically spaced counterparts of the auxiliary fastener openings for permitting adjustment of the vertical offset.

In another aspect of the invention, a scaffold assembly includes a pair of frames, each frame comprising a horizontally spaced pair of column members and an upwardly facing channel member rigidly connected horizontally between the column members proximate lower extremities thereof; a pair of retainer modules for each of the frames, each retainer module being slidingly engagable with a respective column member and having a U-shaped body for slidingly guiding and retaining the retainer module on the column member, and a jaw member pivotally connected to the body portion for contacting the column member opposite the body; a clamp element for clamping the column member between the body and the jaw member, a dog portion of the retainer module projecting horizontally outwardly relative to the column member; and a scaffold bed having a deck surface, transversely oriented downwardly projecting retainer members proximate opposite ends of the bed for engaging respective ones of the channel members, and opposite longitudinal edge deck portions being spaced apart sufficiently for engagement by each of the dog portions of the retainer modules for holding the scaffold bed connected between the channel members. The scaffold assembly can further include a pair of ball joints, a wall brace being connected between the ball joints for stabilizing the scaffold assembly relative to an external structure.

In a further aspect of the invention a scaffold deck includes a plurality of rigid rectangular panel members, each panel member having opposite end and side edges, a pair of rigidly downwardly projecting flange portions extending along respective ones of the end edges, the flange portions being formed for projecting into corresponding laterally extending channel members when the deck is supported on the channel members, the flange portions longitudinally retaining the deck relative to the channel members; a parallel-spaced pair of beam members, upper surfaces of the beam members forming respective edge deck portions of the bed; and fastener means for rigidly connecting the panel members in adjacent coplanar relation between the beam members, upper surfaces of the panel members forming a deck surface, the deck surface being offset below the edge deck portions, upper portions of the beam members forming respective edge barriers.

The scaffold deck can further include an accessory socket rigidly supported relative to the panel members, the socket having a cylindrical opening extending therethrough on a socket axis, the socket axis being inclined non-perpendicular to the deck surface. The accessory socket can include a socket flange portion and a sleeve portion, the cylindrical opening extending through the socket flange and sleeve portions, the sleeve portion projecting through a panel member, the socket flange portion engaging adjacent portions of the deck surface and one of the beam members. The socket axis can extend over one of the beam members perpendicular to a longitudinal direction thereof. Preferably the socket flange portion extends above the beam member for clearing outward projections of accessories that might otherwise be caught on the beam member, the flange portion also having a fastener opening against the beam member for permitting the accessory socket to be more securely anchored by fastening to the beam member.

In still another aspect of the invention, a scaffold deck panel includes a rectangular shell member having opposite end and side edges, a generally planar deck wall extending between the end and side edges, a pair of rigidly downwardly projecting flange portions extending along respective ones of the end edges, each of the flange portions being formed for projecting into a corresponding channel member when the deck panel is supported on the channel member with the channel member extending beyond the side edges, the flange portion longitudinally retaining the deck panel relative to the channel member; a resilient pad supported on the deck wall and forming a generally planar deck surface portion; a shear-resistant core member bonded to the deck wall for reinforcing the shell member, the core member extending to proximate the end and side edges; and a socket member projecting through the shell member proximate one of the side edges thereof and having a cylindrical socket opening formed therethrough on a socket axis, the socket axis extending beyond the one side edge above the deck surface. Preferably the socket member is flush with the side edge and projecting approximately 1.5 inches above the deck surface for supporting an accessory engaging the socket member is spaced relation to a beam member when the beam member is located against the side edge.

DRAWINGS

These and other features, aspects, and advantages of the present invention will become better understood with reference to the following description, appended claims, and accompanying drawings, where:

DESCRIPTION

Figure 1:
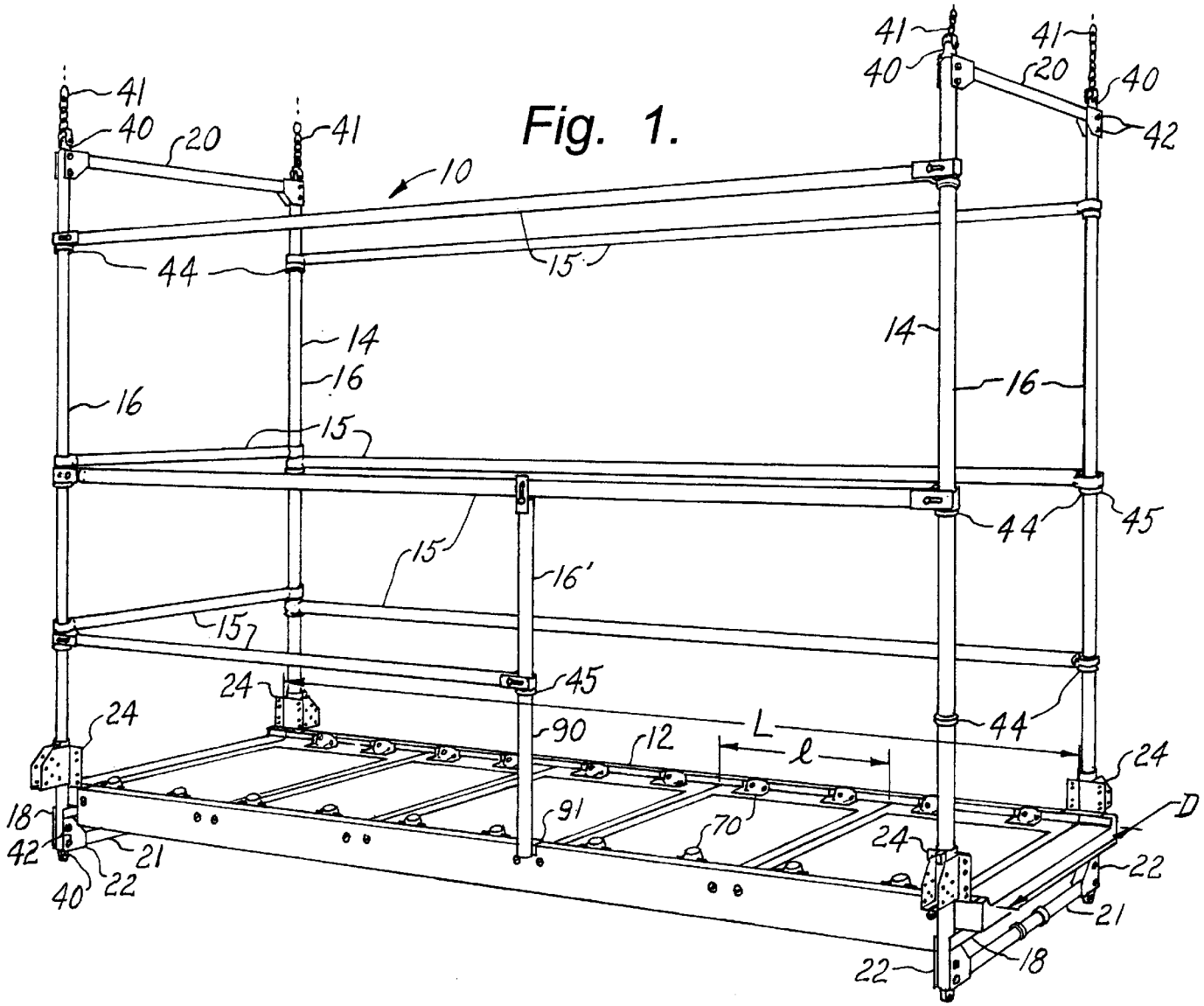
FIG. 1 is a perspective view of a modular scaffold assembly according to the present invention.

The present invention is directed to modular scaffolding construction that is particularly effective for supporting lighting fixtures, grip and sound equipment in studio environments. With reference to FIGS. 1–4 of the drawings, a scaffold system 10 includes a bed 12 that is supported between a pair of suspended hangers 14, the hangers also supporting handrails 15 as appropriate. Each of the hangers 14 includes a spaced pair of column members 16, an upwardly facing channel member 18 connecting the column members proximate lower extremities thereof for engaging opposite ends of the bed 12 as described below. A top cross member 20 is connected between upper extremities of the column members 16, and a bottom cross member 21 is connected between lower extremities of the column members 16 by respective pairs of gusset plates 22, the connections being made by suitable means such as welding. Thus each of the hangers 14 preferably forms a rigid structure, thereby enhancing stability of the system 10. In addition to stiffening the hanger 14, the bottom cross member 21 also serves as a "boot bar" for supporting the feet of workers erecting the scaffold system 10. In an exemplary and preferred configuration as shown in the drawings, the column members 16 and the top and bottom cross members 20 and 21 are formed of high strength structural aluminum alloy tubing. The channel member 18 and the gusset plates 22 are also formed of suitable high strength aluminum alloys; further, the alloys are selected for weldability, the connections being made by welding.

The hangers 14 also each include a pair of retainer modules 24 that slidably engage respective ones of the column members for securing the bed 12 engaged with the channel members 18, and for other purposes indicated below. Each retainer module 24 includes a collar member 26 that slidably engages the corresponding column member, a face member for optionally securing lumber to stage walls, a dog flange 30 for holding the bed downwardly engaged with a corresponding channel member, and a gusset member 32 for receiving wall brace lumber, the gusset member 32 having a gusset flange 34 projecting horizontally at a bottom extremity thereof for temporarily supporting the wall brace lumber during fastening thereof. A retainer set-screw 36 threadingly engages a boss 37 that forms an enlargement of the collar member 26 for clamping the retainer module with the dog flange 30 fixedly spaced above the channel member 18, thereby preventing the bed 12 from being lifted away from the channel member. Each of the face member 28, the dog flange 30, and the gusset member 32 is formed with a plurality of fastener openings 38 extending therethrough for receiving suitable fasteners thereby to secure the dog flange 30 to the bed 12, and to fasten lumber as desired to the face member and to the gusset member. The retainer module 24 is preferably fabricated of a lightweight high strength alloy such as aluminum for facilitating handling of the hangers 14, and for limiting the required load-carrying capacity of the tension members 41.

In the exemplary configuration of the scaffold hanger 14 as shown in the drawings, a support element 40 is secured to the upper extremity of each of the column members 16, axially projecting therefrom and being formed for receiving a clevis pin or other hardware of a tension member 41 such as a chain or cable. The support element 40 is secured to the column member 16 by a pair of transversely oriented support fasteners 42 that project through the element, opposite walls of the column member 16, and colocated ones of the gusset plates 22. Preferably, counterpart support fastener openings 43 are provided proximate both ends of each column member 16 for receiving further support fasteners 42, thereby permitting a stacked configuration of scaffold hangers 14, optionally using further tension members 41 that extend between the scaffold hangers 14 for obtaining a desired spacing between the hangers 14. Further, each of the column members 16 has one or a spaced plurality of enlargements 44 formed thereon for supporting the handrails 15 as described below. The enlargements 44 are formed, for example, as ring members 45 that are welded onto the column members 16.

Figures 2, 3:
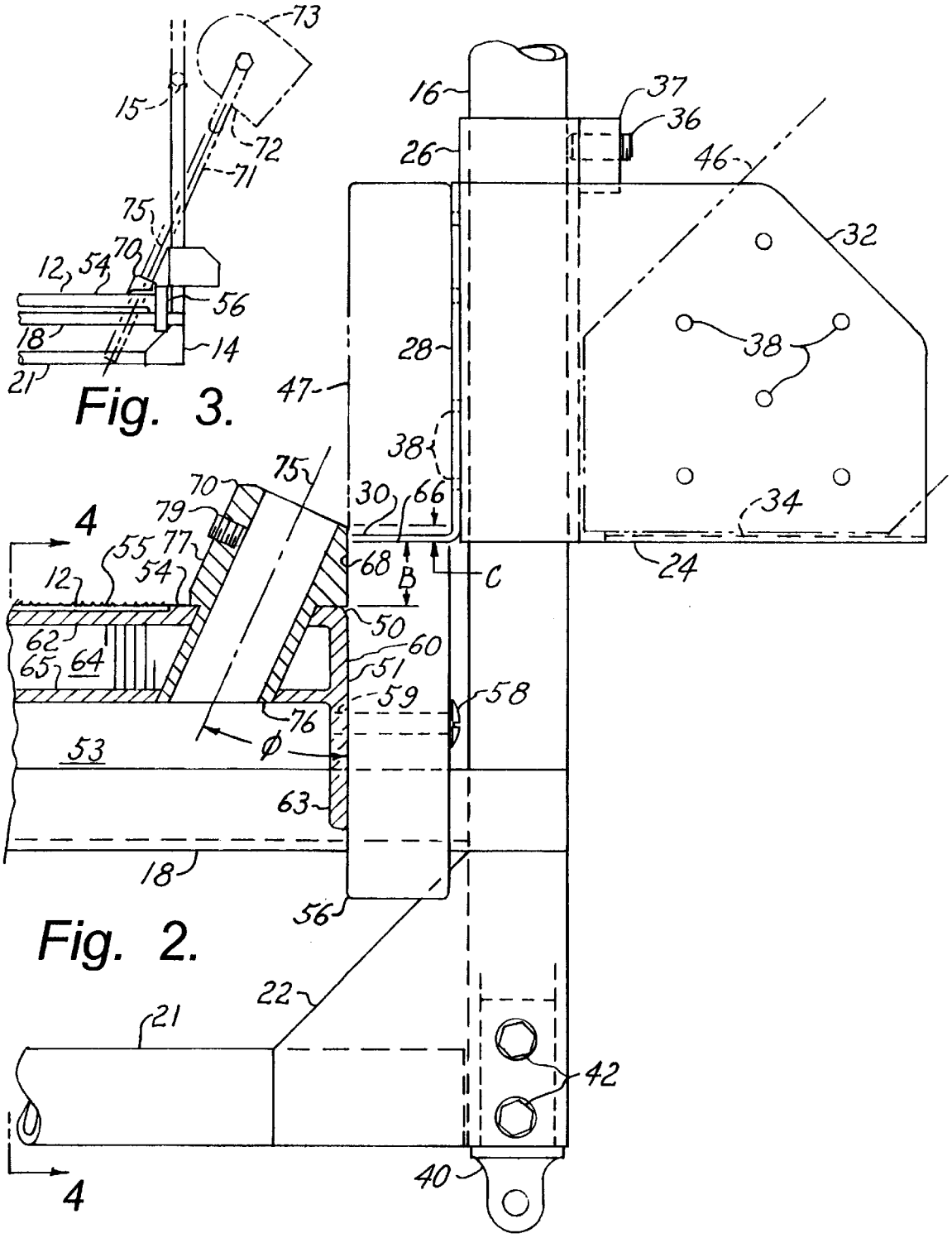
FIG. 2 is a fragmentary sectional elevational view of a portion of the assembly of FIG. 1.
FIG. 3 is an elevational view as in FIG. 2, at reduced scale, and showing a lighting fixture supported by the assembly of FIG. 1.

As best shown in FIG. 2, the retainer modules 24 are particularly suitable for attaching timbers, such as for lateral wall bracing, as indicated at 46, and longitudinal members, as indicated at 47. The lateral wall bracing can extend horizontally or inclined as shown in FIG. 2.

As further shown in the drawings, the bed 12 is preferably an assembly including a rectangular panel member 50 having opposite side edges 51 and end edges 52, respective retainer flange portions 53 downwardly projecting along the end edges 52 for engagement into corresponding channel members 18 of the hangers 14. The panel member 50 has a substantially planar deck surface 54, a resilient mat 55 being inlaid approximately flush with the deck surface 54 and secured to the panel member 50 by a suitable adhesive. Typically, several panel members 50 are disposed in adjacent coplanar relation end-to-end in the bed 12, a pair of beam members 56 being fastened along respective side edges thereof by pairs of deck fasteners 58 for transmitting loading of the bed 12 to opposite ends thereof. The deck fasteners 58 each project through one beam member 56 and into a panel member 50, each panel member 50 having a longitudinally spaced pair of deck fastener openings 59 formed in each of the side edges 51 thereof.

A preferred configuration of the panel member 50 includes a shell member 60 that incorporates the retainer flange portion 53, a deck panel portion 62 that forms a portion of the deck surface 54, and side flange portions 63 in which the deck fastener openings 59 are located. The shell member 50 can be fabricated as a lightweight reinforced plastic structure, using glass or carbon fibers in epoxy resin, for example. A shear-resistant core element 64 is bonded to the underside of the deck panel portion 62, the core element extending between the retainer flanges 53 and between the side flange portions 63 for efficient load transfer from the deck surface 54 thereto. Further, a bottom panel portion 65 of the shell member 60 is bonded to the underside of the core element 64, the bottom panel portion 65 being integrally formed with the retainer flanges 53 and the side flange portions 63. The core element 64 can be formed of a cellular structure of thin sheet material such as aluminum or stiff paper, such being commercially available from a variety of sources.

A particularly convenient and effective implementation of the panel members 50 has a deck width D between the side edges 51 being approximately 39 inches and a panel length l between the end edges 52 being approximately 24 inches. Thus the bed 12 has a length L between the hangers 14 (center to center) being a multiple of the panel length l. Typically, the bed 12 includes five of the panel members 50 as shown in FIG. 1, the length L being approximately 10 feet. As further shown in FIG. 4, the retainer flange portions 53 at opposite ends of the bed 12 can extend downwardly fully to the bottom inside surface of the channel members 18 for support thereby. Also, end portions of the beam members 56 can be formed for resting on top of respective ones of the channel members 18. Thus the support of each end of the bed 12 by the corresponding channel member 18 can be through one or both of the retainer flanges 53 and end portions of the beam members 56. Preferably, upper surfaces beam members 56 form respective edge deck portions 66 that are raised above the panel members 50 by a distance B, inside edges of the beam members above the deck surface 55 forming respective edge barriers 68 for safely confining objects within the deck surface 55.

Figure 4:
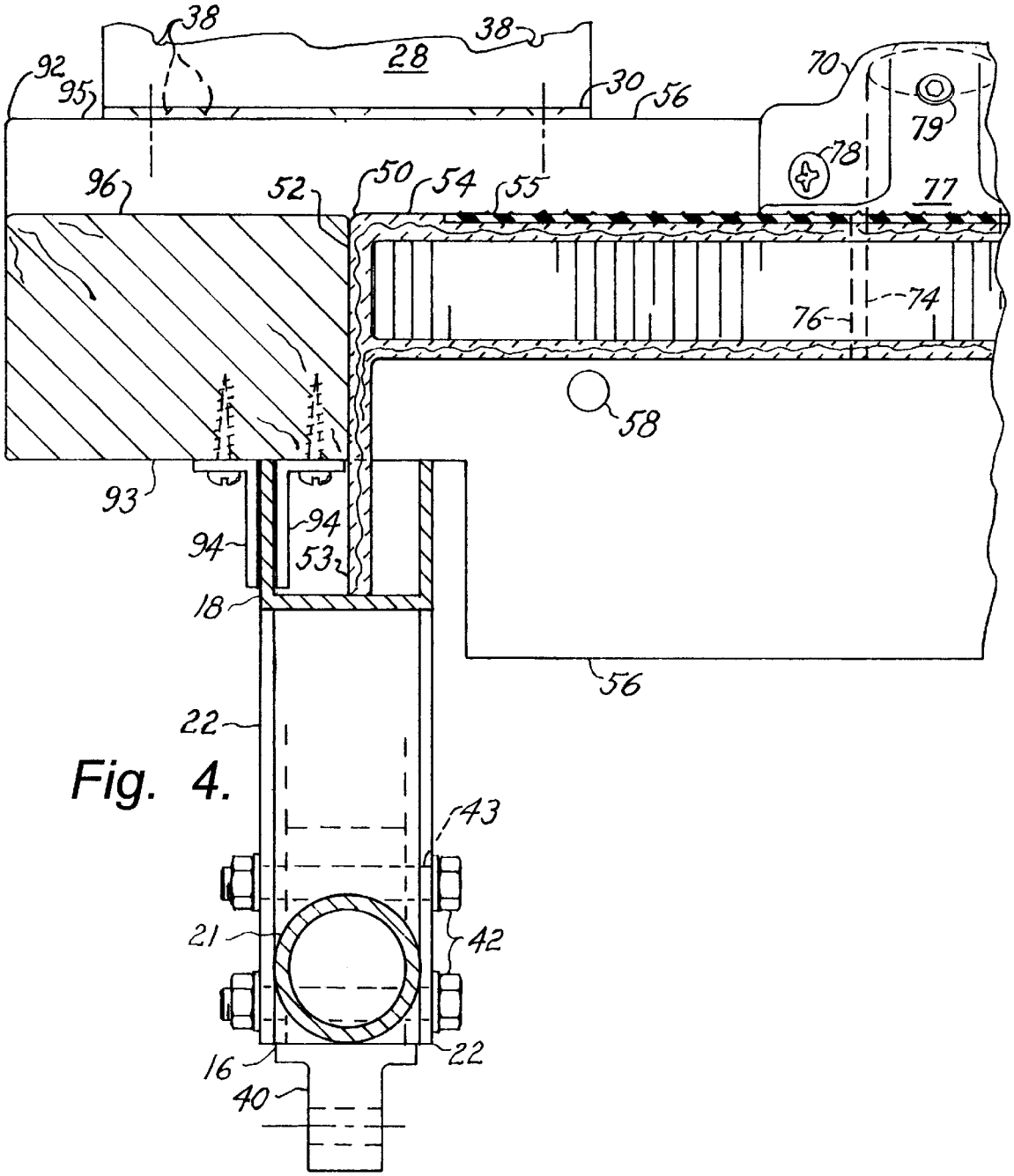
FIG. 4 is a fragmentary sectional elevational view of the assembly of FIG. 1 on line 3—3 of FIG. 2.

An optional yet important feature of the present invention is that the bed 12 is provided with a spaced plurality of inclined socket members 70 for receiving respective yoke stems 71 of fixtures such as lighting fixtures 72 as shown in FIG. 3. The inclination of the socket members 70 facilitates placement of fixture heads 73 laterally outside of the column members 16 and handrails 15 that may extend therebetween. Thus the handrails 15 do not interfere with light transmission from the fixture heads 73 to stage sets being illuminated thereby. Further, the socket members 70 support the fixtures 72 out of the way of grip personnel that may be on the deck surface 54. More particularly, the socket members 70 are preferably located proximate the beam members 56, each having a cylindrical opening 74 therethrough on a socket axis 75, the socket axis 75 being inclined outwardly at a socket angle $\phi$ relative to the side edge 51 as shown in FIG. 2. Typically, the socket axis 75 is normal to the deck surface 54 in a direction parallel to the beam members 56 as shown in FIG. 4. However, it is contemplated within the present invention that the axis 75 can be inclined both laterally and longitudinally, or longitudinally alone, relative to the scaffold bed 12. As further shown in the drawings, the socket member 70 has a sleeve portion 76 that extends through the panel member 50, and a flange portion 77 that abuts the deck surface 54 and the edge barrier 68 (at the intersection of the deck panel portion 62 and the beam member 56). The socket member 70 is anchored in place by a pair of socket fasteners 78 that threadingly engage the corresponding beam member. A fixture set screw 79 threadingly engages the flange portion 77 for fixably clamping the yoke stem 71. Preferably, the flange portion 77, being flush with the side edge 51, extends thereat a distance C above the beam member 56 sufficiently to insure that portions of the fixture 72 that might project outwardly from the yoke stem 71 do not jam against the beam member 56 when the fixture 72 is being adjusted. The distance C is preferably at least 0.25 inch, more preferably approximately 0.5 inch. Thus, the distance B being typically approximately 1.0 inch, the total of the distances B and C is approximately 1.5 inch.

Figure 5:
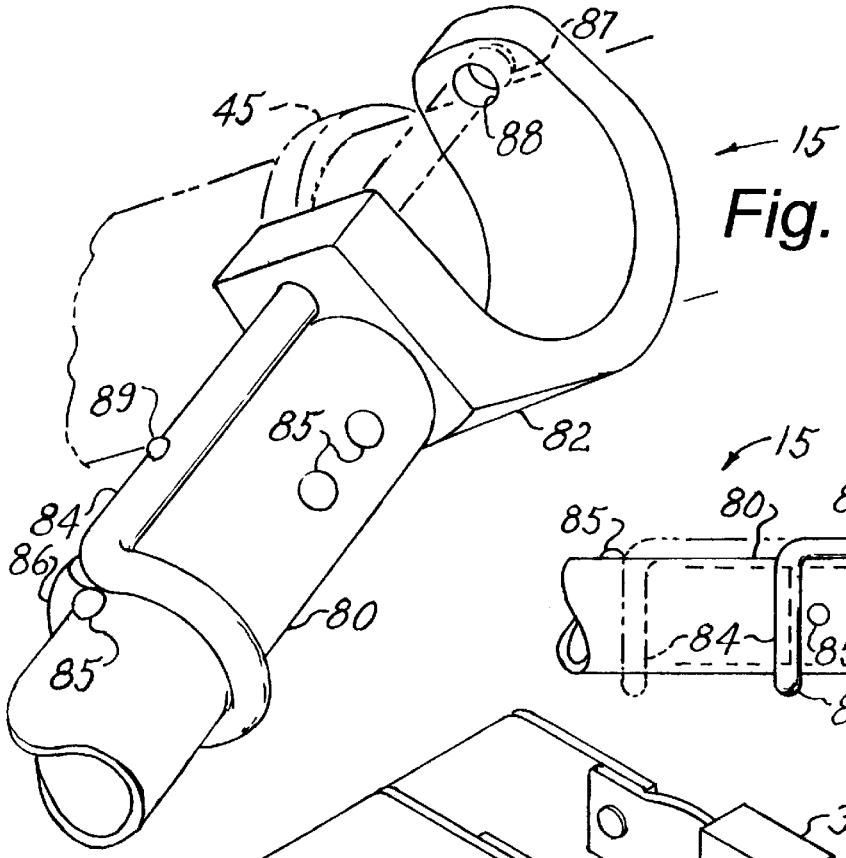
FIG. 5 is a perspective view of a handrail portion of the assembly of FIG. 1.
Figure 6:
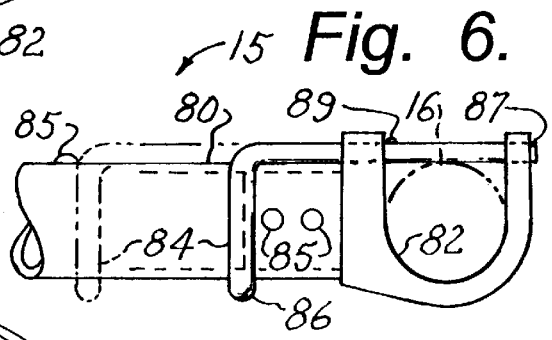
FIG. 6 is a plan view of the handrail portion of FIG. 5.

The scaffold system 10 preferably includes a suitable combination of the handrails 15 being selectably connectable between the column members 16 of the hangers 14 as indicated above. As best shown in FIGS. 5 and 6, each handrail 15 includes a tubular rail member 80 having a hook member 82 rigidly connected to each end thereof for partially enclosing one of the column members 16, and a pair of latch members 84, each latch member projecting through a portion of the corresponding hook member, being movably supported between respective open and closed positions, the open position (depicted by solid lines in FIG. 5) permitting entry of the column member 16 into engagement with the corresponding hook member, the closed position (broken lines in FIG. 5) being effective for locking the hook member 82 onto the column member 16. More particularly, the hook member 82 extends into the rail member 80, being fastened thereto by a pair of rail fasteners 85, which can be drive screws. The latch member 84 is formed of an elongate bar, one end thereof being formed as a handle portion 86 that substantially encircles the rail member 80, one of the fasteners 85 blocking movement of the latch member beyond the closed position. An additional one of the fasteners 85 is located for blocking movement of the latch member 84 beyond the open position, the latch member slidingly engaging the hook member 82 and/or the rail member 80. A nose portion 87 of the latch member 84 extends in the closed position into an opening 88 that is formed proximate an end extremity of the hook member 82 for positively supporting the latch member on opposite sides of the column member 16, thereby securing the handrail 15 on the column member 16. The latch member 84 is provided with a device such as a spring ball 89 as a detent for yieldably maintaining the closed position. It will be understood that the latch member 84 can alternatively be provided with a spring for biasingly maintaining the closed position. As indicated above, the handrails 15 rest on selected ones of the ring members 45 that are vertically spaced on the column members 16. Optionally, one or more auxiliary column members 16' can be located between the hangers 14 for supporting different lengths of the handrails 15. As shown in FIG. 1, an auxiliary column member 16' includes a tubular post 90 having a C-shaped foot member 91 for engaging one of the beam members 56, a ring member 45, and counterparts of the hook member 82, the latch member 84, and the fastener 86 at an upper extremity thereof for engaging a handrail 15 that extends between the hangers 14. Thus the handrails 15 are supplied in various lengths, for connection between the column members 16 of one hanger 14, between the hangers 14, and between a hanger 14 and the auxiliary column member 16'.

Optionally, the scaffold system 10 includes a crossover unit 92 for supporting planks that bridge between assemblies of the system. As best shown in FIG. 3, the crossover unit 92 includes a solid member 93 that is formed of a material such as wood being suitable for receiving and holding nails, and a pair of angle members 94 fastened thereto in spaced relation for engaging opposite sides of one flange of the channel member 18, the member 93 abutting one end of the bed 12. The solid member 93 has a depth for forming flush extensions of the deck edge portions 66 at opposite ends of the member 93 as indicated at 95, a main center portion 96 being of reduced depth for forming a flush extension of the deck surface 54.

Figure 7:
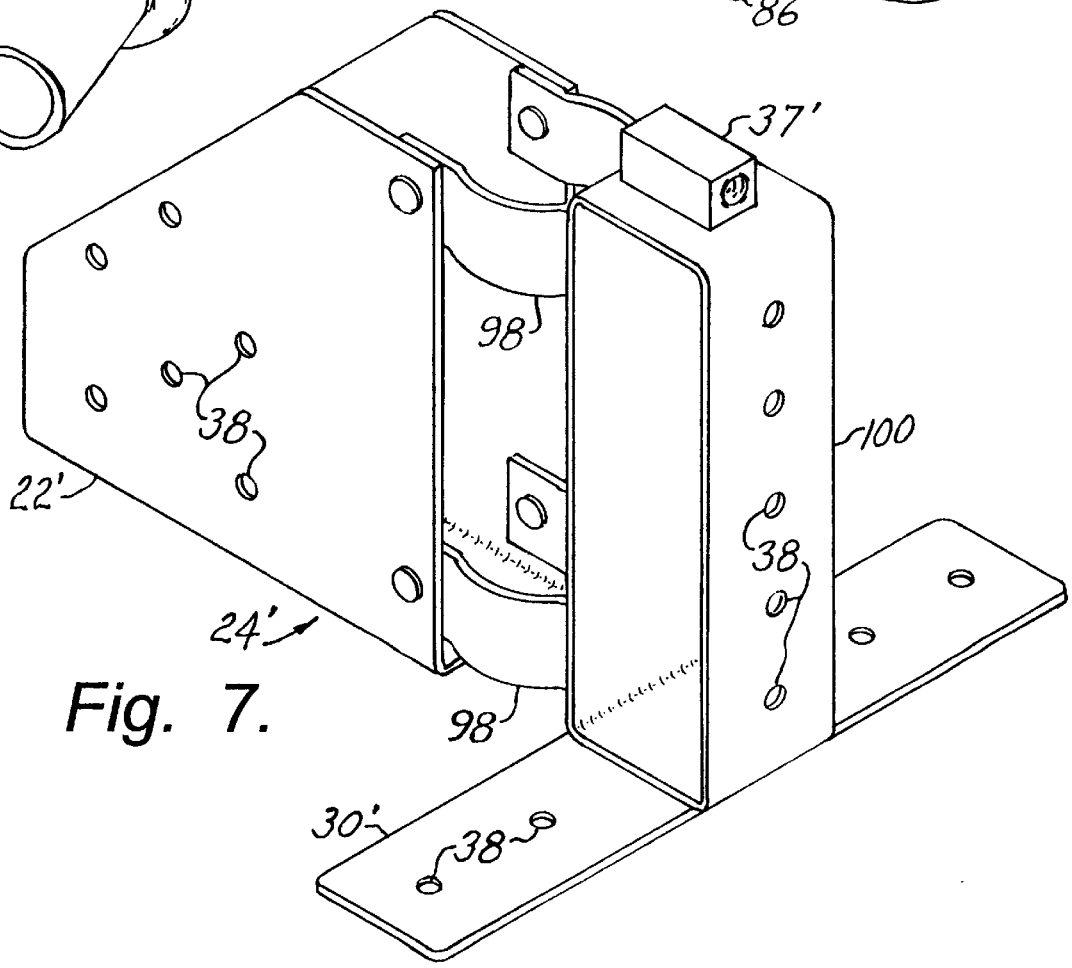
FIG. 7 is a perspective view showing an alternative configuration of a retainer module portion of the assembly of FIG. 1.

With further reference to FIG. 7, an alternative configuration of the retainer module, designated 24', includes counterparts of the gusset plates, designated 32', connected by a pair of collar straps 98 to a rectangularly formed face strap 100, the face strap forming a counterpart of the face member 28 of FIGS. 1–4. A counterpart of the retainer boss, designated 37' is fixed (by welding) to the top of the face strap 100, and a counterpart of the dog flange, designated 30', is welded to the bottom of the face strap 100.

Figure 9:
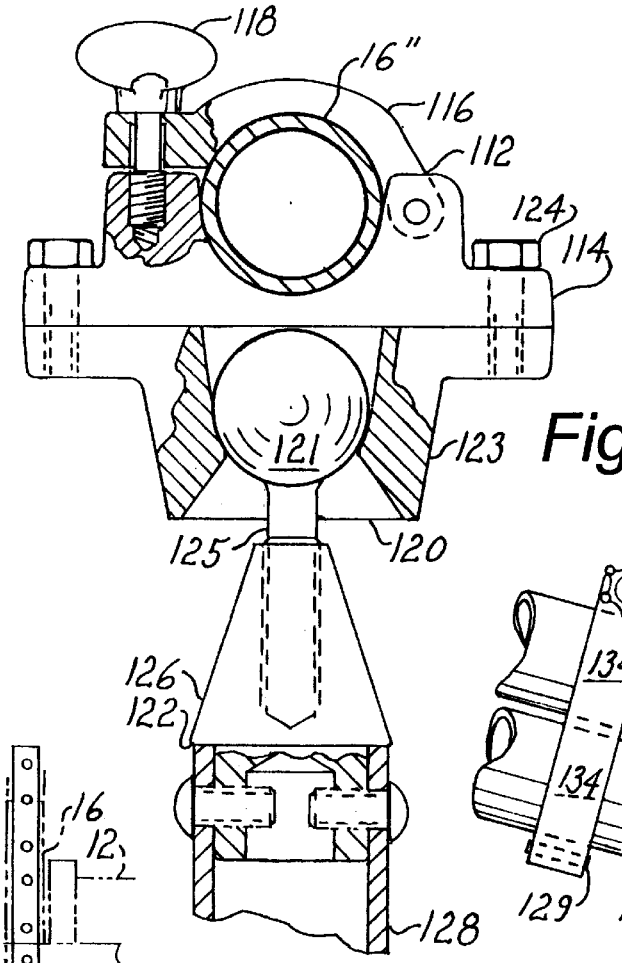
FIG. 9 is a fragmentary sectional view of a retainer portion of the assembly of FIG. 8.
Figure 10:
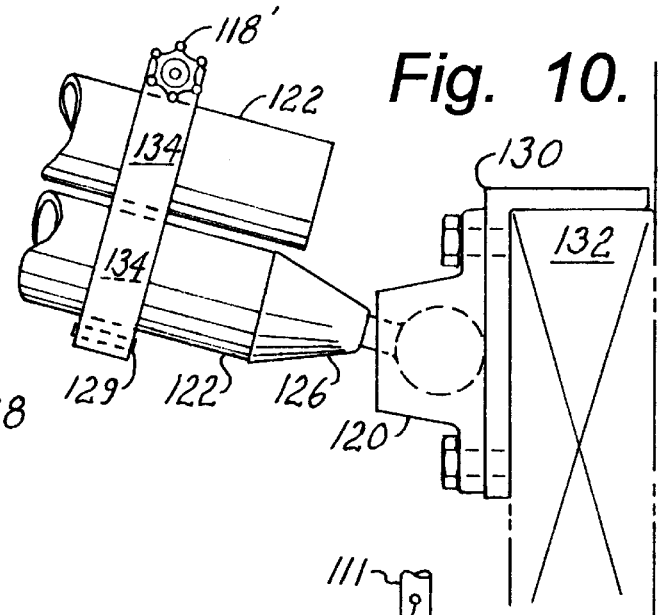
FIG. 10 is a fragmentary elevational view of a wall attachment to the assembly of FIG. 8.
Figure 8:
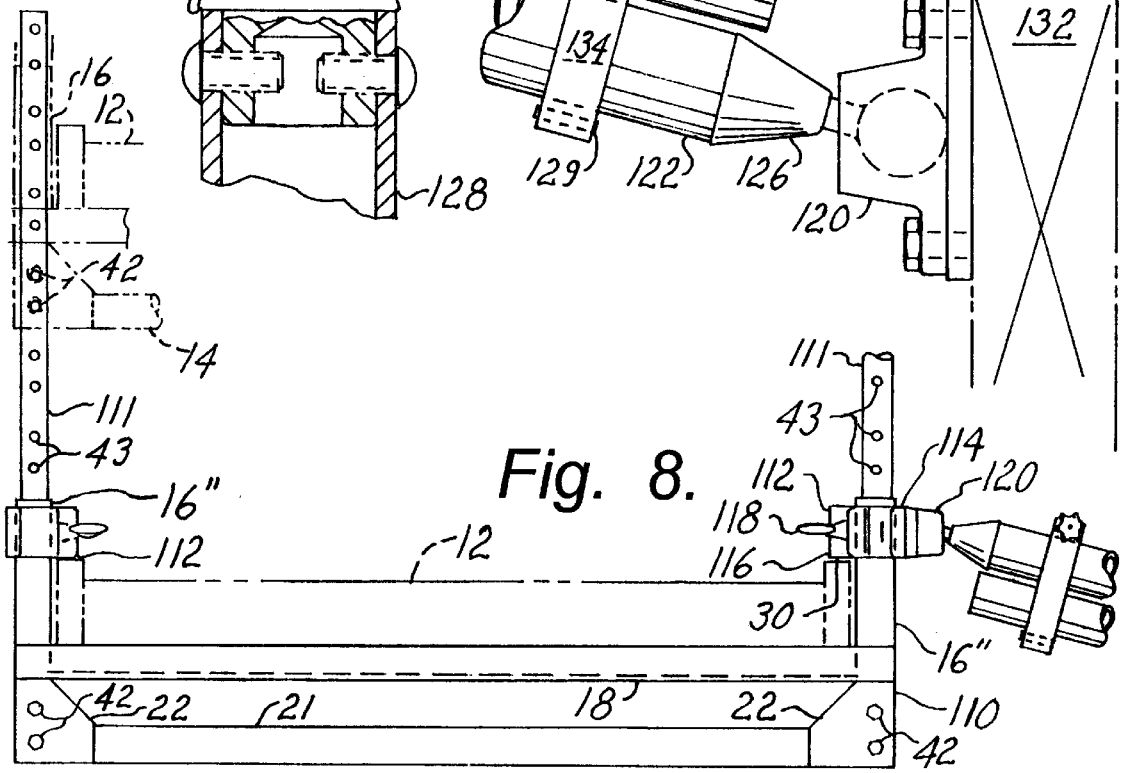
FIG. 8 is a fragmentary elevational view showing another alternative configuration of the assembly of FIG. 1.

With further reference to FIGS. 8–10, another alternative configuration of the scaffold system 10 includes a base 110 having counterparts of the column members, designated 16", and the channel member 18. The base 110 corresponds to the hanger 14, but without the top cross member 20. Optionally, the base 110 includes the bottom cross member 21, omission thereof being appropriate when the base 110 is intended to be placed on supporting structure as an alternative to being suspended by the tension members 41. Thus the column members 16" can be shorter than the column members 16 of FIGS. 1–4, in that head clearance under top cross members 20 is not required. When the bottom cross member 21 is omitted, the gusset plates 22 can be inverted. As further shown in FIG. 8, a pair of extension members 111 form upper portions of the column members 16", being of reduced diameter for fitting into the column members 16 of another hanger 14. The extension members 111 have vertically spaced counterparts of the support fastener openings 43 formed therein for alignment with corresponding openings 43 of the hanger 14, the base 110 being thus adjustably supportable in depending relation to the hanger 14 as an auxiliary hanger, using counterparts of the support fasteners 42. Thus one end of another bed 12 can be supported in vertically offset relation to the bed 12 in the scaffold system 10 of the present invention. The extension members 111 can be separate cylindrical tubes that fit within the column members 16", being fastened thereto by further counterparts of the support fasteners 42 that extend also through the gusset plates 22.

As also shown in FIGS. 8–10, respective dog clamp assemblies 112 can be used in place of the retainer modules 24, each clamp assembly including a U-shaped body 114 having a jaw member 116 pivotally connected thereto, a preferably captive clamp screw 118 extending through the jaw member for threaded engagement with the body 114, thereby providing clamped engagement with the associated column member 16" (or 16). The jaw member 116 thus provides a counter part of the dog flange 30 for retaining the bed 12 engaged with the channel member 18 as described above. As best shown in FIG. 9, a ball joint 120 can be attached to the clamp assembly 112 for receiving a wall brace 122, the ball joint 120 including a ball member 121 and a retainer block 123 that is rigidly connected to the body 114 by threaded fasteners 124, a stem portion 125 of the ball member projecting through the block 123 and threadingly engaging a tube fitting 126 of the wall brace 122. Thus the ball joint 120 replaces the gusset members 32 of the retainer module 24. The retainer block 123 is formed for permitting pivotal movement of the ball member 121, the ball member being captured between the block 123 and the body 114.

The tube fitting 126 is formed for axially engaging a brace tube 128 of the wall brace 122, being affixed thereto by a pair of the rail fasteners 85. Counterparts of the brace tube 128 and the tube fitting 126 are adjustably clamped in close proximity and opposing end to end relation by a pair of tube clamps 129, the counterpart tube fitting 126 forming an opposite end of the wall brace 122. As shown in FIG. 10, the opposite end of the wall brace 122 is attached by a counterpart of the ball joint 120 to a wall bracket 130 that can be anchored to a timber wall plate or other stationary structural member. The tube clamps 129 include pivotally connected jaws 134 that are doubly contoured correspondingly with the body 114 and jaw member 116 of the dog clamp assembly, for receiving the brace tubes 128 in side-by-side relationship, clamping being effected by an enlarged counterpart of the clamp screw, designated 118'.

Although the present invention has been described in considerable detail with reference to certain preferred versions thereof, other versions are possible. For example, the panel members 50 can be provided in different lengths such as multiples of a base panel length, and when the bed 12 has a single panel member only, the beam members can be integrally formed with the panel member. Also, panel members can be pie-shaped for forming deck intersections at 45°, 22.50, or other angles. Therefore, the spirit and scope of the appended claims should not necessarily be limited to the description of the preferred versions contained herein.

What is claimed is:

1. A scaffold hanger comprising:

(a) a frame comprising a horizontally spaced pair of tubular column members, and an upwardly facing channel member rigidly connected horizontally between the column members proximate lower extremities thereof;

(b) means associated with each of the column members for connecting each of the column members to a support element for vertically transmitting load forces between the support element and the respective column member;

(c) a pair of retainer modules, each retainer module slidingly engaging a respective column member and comprising:

(i) a collar portion for slidingly guiding and retaining the retainer module on the column member;

(ii) a vertically oriented face portion; and (iii) a dog portion projecting horizontally outwardly relative to the column member, the face portion having a plurality of fastener openings formed therein for connecting a structural member;

(d) means for holding each retainer module in a lowered position with the dog portion thereof fixedly spaced above the channel member; and wherein at least one of the retainer modules includes a gusset portion, the gusset portion being vertically oriented perpendicular to the face portion and having a further plurality of the fastener openings formed therein.

2. The scaffold hanger of claim 1, further comprising a pair of support elements axially engaging respective ones of the column members, wherein the means for connecting comprises each of the support elements being secured by a respective support fastener, the support fastener transversely projecting through one of the column member and the support element and at least partly through the other of the column member and the support element.

3. The scaffold hanger of claim 2, wherein the column members are tubular, opposite walls thereof having respective transversely oriented support fastener openings formed therein proximate upper and lower extremities of the column members for securing respective pairs of the support elements to the column members.

4. The scaffold hanger of claim 1, further comprising a top cross member rigidly connected between upper extremities of the column members.

5. The scaffold hanger of claim 1, further comprising a shelf portion projecting horizontally perpendicular to a bottom extremity of the gusset portion for temporarily supporting a structural member to be fastened to the gusset portion.

6. The scaffold hanger of claim 1, wherein the gusset portion is one of a horizontally spaced pair of gusset portions.

7. The scaffold hanger of claim 1, further comprising a horizontal boot bar rigidly extending between the column members and spaced below the channel member.

8. A scaffold hanger comprising:

(a) a frame comprising a horizontally spaced pair of tubular column members, and an upwardly facing channel member rigidly connected horizontally between the column members proximate lower extremities thereof;

(b) means associated with each of the column members for connecting each of the column members to a support element for vertically transmitting load forces between the support element and the respective column member;

(c) a pair of retainer modules, each retainer module slidingly engaging a respective column member and comprising:

(i) a collar portion for slidingly guiding and retaining the retainer module on the column member;

(ii) a vertically oriented face portion; and (iii) a dog portion projecting horizontally outwardly relative to the column member, the face portion having a plurality of fastener openings formed therein for connecting a structural member; and (d) means for holding each retainer module in a lowered position with the dog portion thereof fixedly spaced above the channel member, wherein at least one of the dog portions forms a foot plate, opposite ends of the foot plate projecting horizontally beyond opposite sides of the column member, the foot plate having a further plurality of the fastener openings formed therein for fastening the dog portion to structure below the foot plate.

9. The scaffold hanger of claim 8, wherein a side extremity of the foot plate extends proximate a bottom extremity of the face portion and parallel thereto.

10. A scaffold assembly comprising:

(a) a spaced pair of scaffold hangers, each hanger comprising:

(b) a frame comprising a horizontally spaced pair of tubular column members, and an upwardly facing channel member rigidly connected horizontally between the column members proximate lower extremities thereof;

(i) means associated with each of the column members for connecting each of the column members to a support element for vertically transmitting load forces between the support element and the respective column member;

(ii) a pair of retainer modules, each retainer module slidingly engaging a respective column member and comprising a collar portion for slidingly guiding and retaining the retainer module on the column member, a vertically oriented face portion, and a dog portion prolecting horizontally outwardly relative to the column member, the face portion having a plurality of fastener openings formed therein for connecting a structural member; and (iii) means for holding each retainer module in a lowered position with the dog portion thereof fixedly spaced above the channel member; and (c) a scaffold bed having a deck surface, transversely oriented downwardly projecting retainer members proximate opposite ends of the bed for engaging respective ones of the channel members, and opposite longitudinal edge deck portions being spaced apart sufficiently for engagement by each of the dog portions of the scaffold hangers for holding the scaffold bed connected between the channel members.

11. The scaffold assembly of claim 10, further comprising a handrail member connected between the hangers in spaced relation above the bed.

12. The scaffold assembly of claim 11, wherein:

(a) a pair of the column members has respective projections formed thereon for supporting the handrail;

(b) the handrail having respective hook members rigidly formed on opposite ends thereof for partially enclosing the columns, each hook member having an opening formed therein;

(c) a pair of latch members connected proximate the hook members and being movable between respective open and closed positions for releasably securing the corresponding hook members on the respective column members, each latch member slidingly engaging the handrail and having a nose portion, the nose portions projecting into the openings of the hook members in the closed positions of the latch members for supporting the latch members on opposite sides of the respective column members; and (d) a pair of closure devices, each closure device engaging a respective one of the latch members for releasably holding the latch members in the closed positions thereof.

13. The scaffold assembly of claim 10, wherein the scaffold bed comprises:

(a) a plurality of rigid rectangular panel members for forming the deck surface, each panel member having opposite end and side edges;

(b) a parallel-spaced pair of beam members, upper surfaces of the beam members forming the edge deck portions of the bed; and (c) fastener means for rigidly connecting the panel members in adjacent coplanar relation between the beam members.

14. The scaffold assembly of claim 13, wherein the beam members project above the deck surface, inside portions of the beam members forming respective edge barriers of the bed.

15. The scaffold assembly of claim 13, wherein each panel member comprises a shell member, a pair of rigidly downwardly projecting retainer flange portions extending along respective ones of the end edges, a pair of the retainer flange portions forming the retainer members, and the fastener means including a spaced plurality of beam fastener openings being formed in each of the side edges.

16. The scaffold assembly of claim 13, wherein the fastener means comprises a pair of threaded deck fasteners connecting each beam member to respective side edges of each of the panel members, the beam members projecting above the panel members and spacing the edge deck portions above the deck surface for forming respective edge barriers.

17. The scaffold assembly of claim 10, wherein the bed further comprises a socket member having a cylindrical opening therethrough for receiving a fixture yoke shank on a socket axis, the socket member being located proximate an edge of the deck surface, the socket axis being inclined outwardly and upwardly relative to the deck surface.

18. The scaffold assembly of claim 17, wherein the socket axis is inclined at an angle $\phi$ from being normal to the deck surface, the angle $\phi$ being between approximately 20 degrees and approximately 35 degrees.

19. The scaffold assembly of claim 18, wherein the angle $\phi$ is approximately 24 degrees.

20. The scaffold assembly of claim 10, further comprising a deck extension cantilevered from one of the hangers and abutting the bed.

21. The scaffold assembly of claim 20, wherein the deck extension is supported by the channel member of one of the hangers, being tied to the bed by the retainer modules thereof.

22. A scaffold deck comprising:

(a) a plurality of rigid rectangular panel members, each panel member having opposite end and side edges, a pair of rigidly downwardly projecting flange portions extending along respective ones of the end edges, the flange portions being formed for projecting into corresponding laterally extending channel members when the deck is supported on the channel members, the flange portions longitudinally retaining the deck relative to the channel members;

(b) a parallel-spaced pair of beam members, upper surfaces of the beam members forming respective edge deck portions of the bed;

(c) fastener means for rigidly connecting the panel members in adjacent coplanar relation between the beam members, upper surfaces of the panel members forming a deck surface, the deck surface being offset below the edge deck portions, upper portions of the beam members forming respective edge barriers; and (d) an accessory socket rigidly supported relative to the panel members, the socket having a cylindrical opening extending therethrough on a socket axis, the socket axis being inclined non-perpendicular to the deck surface, wherein the accessory socket includes a socket flange portion and a sleeve portion, the cylindrical opening extending through the socket flange and sleeve portions, the sleeve portion projecting through one of the panel members, the socket flange portion engaging adjacent portions of the deck surface and one of the beam members.

23. The scaffold deck of claim 22, wherein the socket axis extends over one of the beam members perpendicular to a longitudinal direction thereof.

24. The scaffold deck of claim 22, wherein the socket flange portion extends above the one beam member, the socket flange portion also having a fastener opening therein for connection to the one beam member.

25. A scaffold deck panel comprising:

(a) a rectangular shell member having opposite end and side edges, a generally planar deck wall extending between the end and side edges, a pair of flange walls extending along respective ones of the end edges, each of the flange walls being formed for projecting rigidly downwardly from the end edges into a corresponding channel member when the deck panel is supported on the channel member with the channel member extending beyond the side edges, the flange portion longitudinally retaining the deck panel relative to the channel member;

(b) a resilient pad supported on the deck wall and forming a generally planar deck surface portion;

(c) a shear-resistant core member bonded to the deck wall for reinforcing the shell member, the core member extending to proximate the end and side edges; and (d) a socket member projecting through the deck wall of the shell member proximate one of the side edges thereof and having a cylindrical socket opening formed therethrough on an inclined socket axis, the socket axis extending beyond the one side edge above the deck surface.

26. The scaffold deck panel of claim 25, wherein the socket member is flush with the one side edge, the socket member also projecting above the deck surface approximately 1.5 inches at the one side edge.

* * * * *